US005097555A

United States Patent [19]

Dwyer

[11] Patent Number: 5,097,555

[45] Date of Patent: Mar. 24, 1992

[54] DRILL BIT AND SCREW DRIVER KIT

[76] Inventor: Steven M. Dwyer, 728 Wandering Way, Oklahoma City, Okla. 73170

[21] Appl. No.: 612,549

[22] Filed: Nov. 13, 1990

[51] Int. Cl.[5] ..... B26B 11/00

[52] U.S. Cl. ..... 7/158; 7/138; 7/165

[58] Field of Search ..... 7/138, 158, 165; 81/436, 437, 438, 439, 460

[56] References Cited

U.S. PATENT DOCUMENTS

| | | | |
|---|---|---|---|
| 2,108,344 | 2/1938 | Miller | 7/165 X |
| 4,468,826 | 9/1984 | Moores, Jr. | 7/158 |
| 4,525,111 | 6/1985 | Gutsche | 7/158 X |
| 4,791,690 | 12/1988 | Kuang-Wu | 7/158 X |
| 4,796,319 | 1/1989 | Taft | 7/158 |
| 4,954,025 | 9/1990 | Crawford et al. | 7/158 X |

*Primary Examiner*—James G. Smith

*Attorney, Agent, or Firm*—Leon Gilden

[57] ABSTRACT

A kit assembly including a support block mounting a first and second screw driver member arranged for reception and securement within a conventional drill chuck, wherein a plurality of pilot drill assemblies are provided, with each pilot drill assembly including a rearwardly positioned cavity to complementarily receive one of the plurality of drill bit members therewithin to permit initial use of a pilot drill and subsequent use of a drill bit. Further, adapter members are provided to utilize a first style screw driver forward end and a cavity complementarily receiving a screw driver of a further configuration, such as a blade screw driver adapter provided with a Phillips head type cavity to permit use of varying screw driver assemblies in association with a single mounted screw driver member mounted within the aforenoted drill.

1 Claim, 4 Drawing Sheets

PRIOR ART

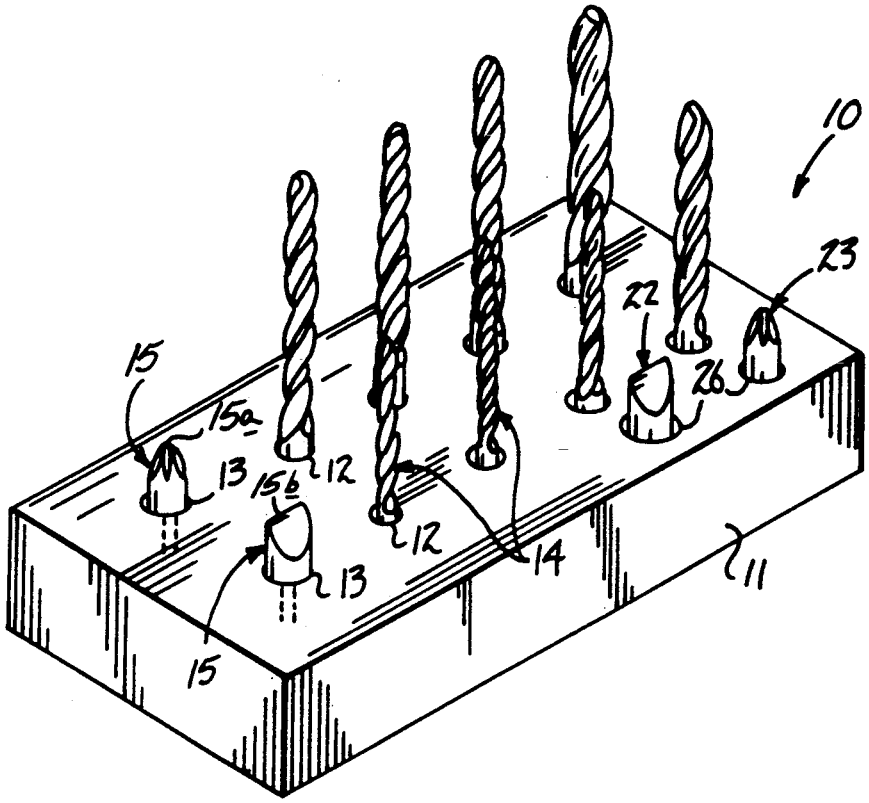
FIG 3
FIG 4
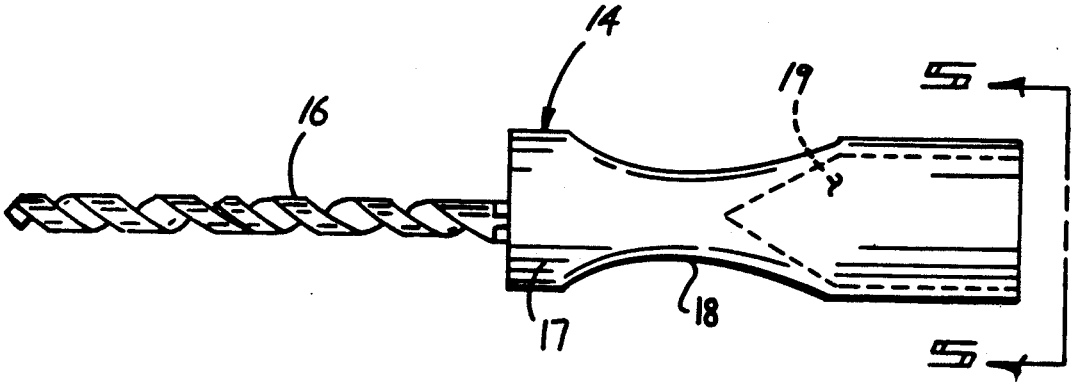

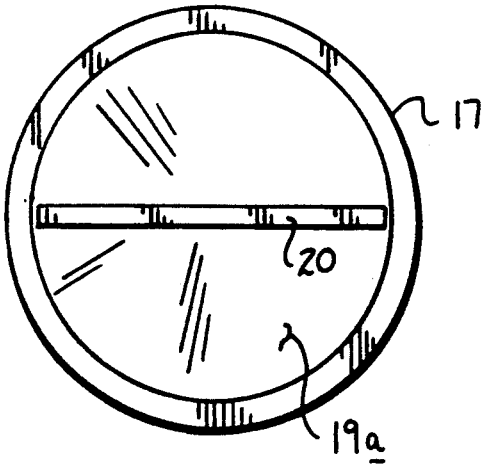
Fig 5
Fig 6
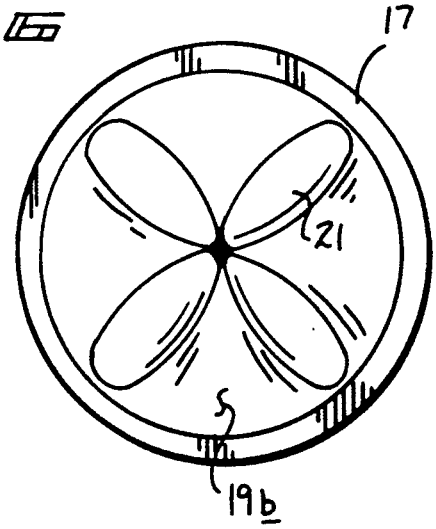
Fig 7
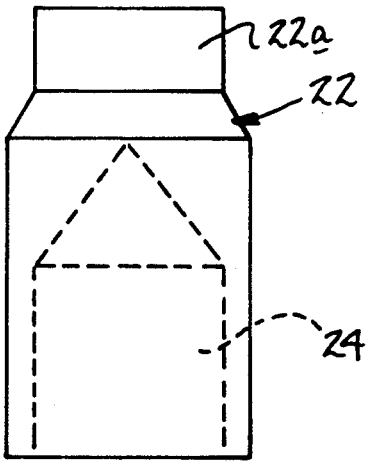

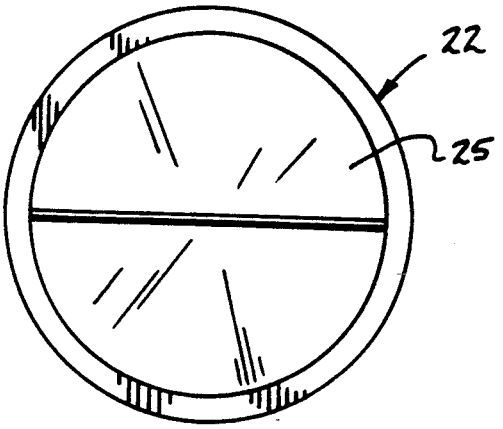
Fig 8
Fig 9
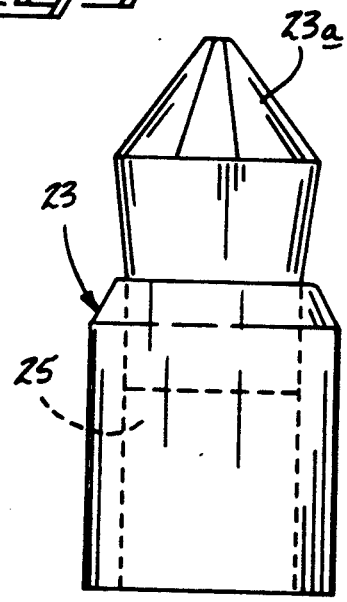
Fig 10
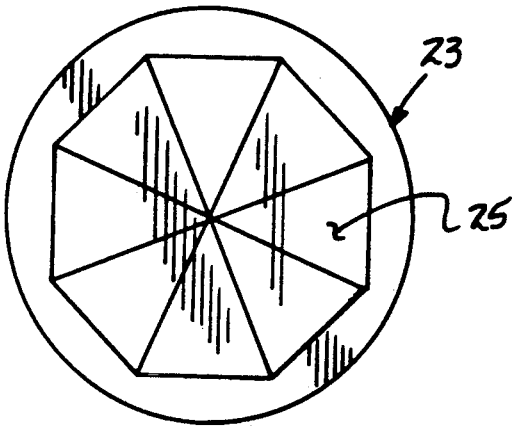

DRILL BIT AND SCREW DRIVER KIT

BACKGROUND OF THE INVENTION

1. Field of the Invention

The field of invention relates to rotary drill members, and more particularly pertains to a new and improved drill bit and screw driver kit wherein the same permits a pilot drill member to be provided with a screw driver type cavity to complementarily receive a screw driver forward end therewithin to permit initial drilling of a pilot drill prior to a screw driver procedure.

2. Description of the Prior Art

In a typical screw driver type procedure wherein a screw driver type fitting is mounted to a drill member, pilot holes are initially provided to accommodate a screw driver type member for subsequent insertion of the screw driver member within the pilot hole permitting subsequent securement of the aforenoted screw into the pilot hole. The instant invention attempts to overcome deficiencies of the prior art by providing a pilot hole adapter mounting a forwardly and coaxially aligned drill bit to a shank that in turn is provided with a rear cavity of a complementary configuration to an associated screw driver member mounted within the aforenoted drill. Examples of the prior art illustrating the use of various adapter organizations may be found in U.S. Pat. No. 4,796,319 to Taft wherein a magnetic tubular member is mounted to a drill bit, wherein the tubular member includes a forward socket permitting reception of a screw driver type insert bit.

U.S. Pat. No. 4,525,111 to Gutsche sets forth an organization illustrating a plurality of coaxially aligned adapter members mounted relative to one another in an aligned relationship.

U.S. Pat. No. 4,413,937 to Gutsche sets forth various tool element members mounted to an associated drill chuck assembly.

U.S. Pat. No. 4,320,544 to Bryant sets forth a combination drill and screw driver, wherein the screw driver medially accepts the pilot drill for subsequent removal and permitting use of the remaining apparatus in a screw driver form.

U.S. Pat. No. 4,617,692 to Bond, et al. sets forth a drill tip arranged for threaded mounting to a lower or forward terminal end of a threaded shank of a wall anchor permitting initial drilling of an opening within the wall body forward tip.

As such, it may be appreciated that there continues to be a need for a new and improved drill bit and screw driver kit as set forth by the instant invention which addresses both the problems of ease of use as well as selective mounting of a pilot drill member to a forward end of a screw driver bit for convenience in providing initial pilot holes prior to screw driver use and in this respect, the present invention substantially fulfills this need.

SUMMARY OF THE INVENTION

In view of the foregoing disadvantages inherent in the known types of drill bit members now present in the prior art, the present invention provides a drill bit and screw driver kit wherein the same provides for an assembly to complementarily receive a screw driver bit mounted to an associated drill for insertion of a pilot hole prior to a screw driver procedure. As such, the general purpose of the present invention, which will be described subsequently in greater detail, is to provide a new and improved drill bit and screw driver kit which has all the advantages of the prior art drill bit apparatus and none of the disadvantages.

To attain this, the present invention provides a kit assembly including a support block mounting a first and second screw driver member arranged for reception and securement within a conventional drill chuck, wherein a plurality of pilot drill assemblies are provided, with each pilot drill assembly including a rearwardly positioned cavity to complementarily receive one of the plurality of drill bit members therewithin to permit initial use of a pilot drill and subsequent use of a drill bit. Further, adapter members are provided to utilize a first style screw driver forward end and a cavity complementarily receiving a screw driver of a further configuration, such as a blade screw driver adapter provided with a Phillips head type cavity to permit use of varying screw driver assemblies in association with a single mounted screw driver member mounted within the aforenoted drill.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved drill bit and screw driver kit which has all the advantages of the prior art drill bit apparatus and none of the disadvantages.

It is another object of the present invention to provide a new and improved drill bit and screw driver kit which may be easily and efficiently manufactured and marketed.

It is a further object of the present invention to provide a new and improved drill bit and screw driver kit which is of a durable and reliable construction.

An even further object of the present invention is to provide a new and improved drill bit and screw driver kit which is susceptible of a low cost of manufacture with regard to both materials and labor, and which accordingly is then susceptible of low prices of sale to the consuming public, thereby making such drill bit and screw driver kits economically available to the buying public.

Still yet another object of the present invention is to provide a new and improved drill bit and screw driver kit which provides in the apparatuses and methods of the prior art some of the advantages thereof, while simultaneously overcoming some of the disadvantages normally associated therewith.

Still another object of the present invention is to provide a new and improved drill bit and screw driver kit wherein the same provides for a convenient adapter mounted to a drill mounted screw driver bit to permit forming of an initial pilot hole prior to a screw driving procedure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an isometric illustration of the kit of the instant invention.

FIG. 4 is an orthographic side view, taken in elevation, of a drill adapter utilized by the instant invention.

FIG. 5 is an orthographic view, taken along the lines 5—5 of FIG. 4 in the direction indicated by the arrows.

FIG. 6 is an orthographic end view of an alternative cavity utilized by a drill bit adapter of the instant invention.

FIG. 7 is an orthographic view, taken in elevation, of a first adapter screw driver member.

FIG. 8 is an orthographic bottom view of FIG. 7.

FIG. 9 is an orthographic view, taken in elevation, of a second adapter screw driver member utilized by the instant invention.

FIG. 10 is an orthographic bottom view of FIG. 9.

DESCRIPTION OF THE PREFERRED EMBODIMENT

Figure 1:
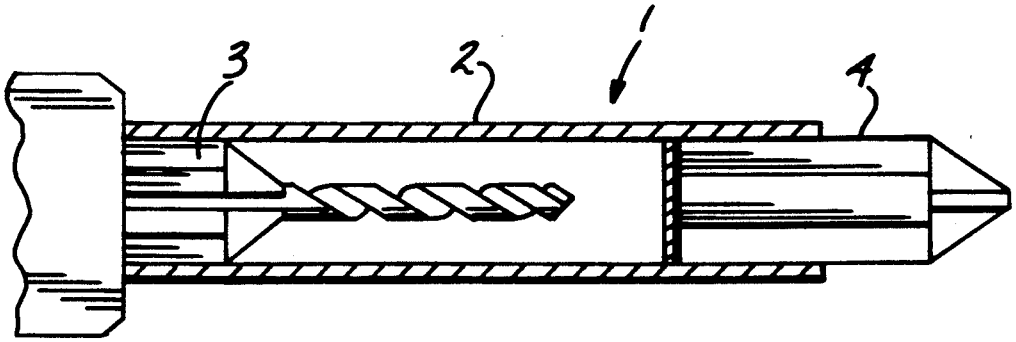
FIG. 1 is an orthographic cross-sectional illustration of a prior art drill bit adapter mounted to an associated drill.

With reference now to the drawings, and in particular to FIGS. 1 to 10 thereof, a new and improved drill bit and screw driver kit embodying the principles and concepts of the present invention and generally designated by the reference numeral 10 will be described.

Figure 2:
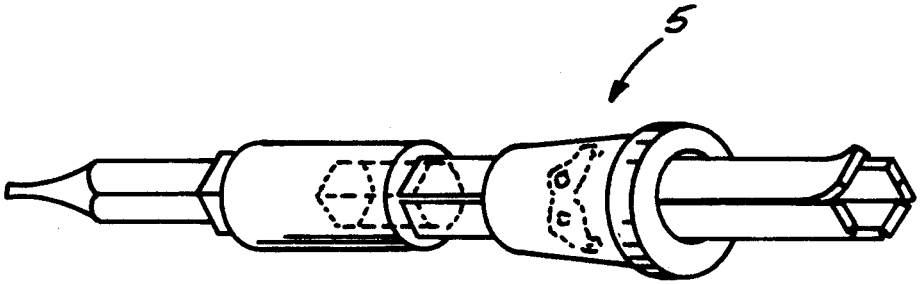
PRIOR ART Fig 2
FIG. 2 is an isometric illustration of a further example of a prior art adapter organization for use with rotary tools.

FIG. 1 is a prior art adapter organization, wherein a magnetic sleeve 2 is secured to a drill bit chuck 3, with a forward socket to receive a screw driver member 4 therewithin to define the prior art organization 1, as set forth in U.S. Pat. No. 4,796,319. FIG. 2 sets forth a further prior art adapter organization 5 utilizing a plurality of aligned adapters typically utilized in rotary tools.

More specifically, the drill bit and screw driver kit 10 of the instant invention essentially comprises a support block 11, the support block including a matrix of bores, including a first plurality of first bores 12, with each of the first bores 12 including a pilot drill assembly 14, with each pilot drill assembly including a forwardly extending drill bit 16 (see FIG. 4) of varying graduated sizes. The second bores 13 include respective screw driver bit adapters 15, including a Phillips head forward end **15*a* and a standard screw driver blade bit 15*b*, with each of the screw driver bit adapters including a rearwardly and coaxially aligned shank receivable within an associated collett of a conventional rotary drill. The pilot drill adapter assemblies 14 each include the aforenoted forwardly extending elongate pilot drill bit 16 coaxially aligned with a support shank 15. Each support shank 15 is defined by a first diameter including an elliptical concave surface 18 formed circumferentially adjacent a forward end of each support shank 17 to permit accommodation of an individual's hand therewithin during rotation of each pilot drill adapter assembly, and an individual may manually grasp the shank at the concave surface 18 for maintaining securement and positioning of each shank about an associated screw driver bit adapter 15 that in turn is received within a respective socket cavity 19. Each socket cavity 19 is formed of either a blade cavity 19*a* or a Phillips head cavity 19*b* to complementarily receive an associated and like screw driver bit adapter 15*b* or 15*a* within the socket cavity 19. Accordingly, each respective standard blade cavity 19*a* and Phillips head cavity 19*b* includes a respective blade cavity forward edge 20 that is orthogonally oriented relative to the elongate axis of the shank 17 and the socket cavity 19, or alternatively a Phillips head forward end 21 coaxially aligned with the shank 17**.

Further, the kit includes a plurality of adapter screw driver bits, including a first adapter screw driver bit 22 and a second adapter screw driver bit 23. The first adapter screw driver bit 22 includes a screw driver blade **22*a*, while the second adapter screw driver bit 23 includes a Phillips head screw driver forward end 23*a*. The first adapter screw driver bit 22 includes a Phillips head cavity 24, while the second adapter screw driver bit 23 includes a screw driver blade cavity 25 that is provided with a screw driver blade cavity 25 defined by an elongate edge to receive the associated blade of a screw driver blade therewithin. This permits an individual to merely mount a single screw driver bit adapter 15 into an associated collett and thereafter utilize an appropriate adapter screw driver bit 22 or 23 to provide an alternative screw driver bit member that in turn may accommodate a pilot drill adapter 14 thereon. The first and second adapter screw driver bits 22 and 23 are accordingly received within the third bores 26 within the support block 11**.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A drill bit and screw driver kit apparatus comprising, in combination, a support mount, the support mount including a plurality of first bores, a plurality of second bores, and a plurality of third bores directed into the support mount, and the first bores each including a pilot adapter drill, each pilot adapter drill including an elongate pilot drill bit coaxially aligned to and fixedly mounted to a forward end of a support shank, and the support shank including a support shank cavity directed into the shank coaxially aligned with the shank and the pilot drill bit, wherein at least one of the plurality of pilot drill adapters includes a shank cavity of a first cavity configuration and wherein at least one further shank cavity of the plurality of pilot drill adapters is defined by a second screw driver cavity configuration, and a plurality of screw driver bit adapters slidably received within the second bores, wherein at least one screw driver bit of the plurality of screw driver bit adapters includes a forward end of a first configuration complementarily received within the first cavity configuration, and wherein at least one of the screw driver bit adapters includes a further forward end defined by a second configuration complementarily received within the second screw driver cavity configuration, and each of the screw driver bit adapters includes an elongate coaxially aligned shank for reception within a drill chuck, and further including a plurality of adapter screw driver bits receivable within the third bores, wherein at least one of the plurality of adapter screw driver bits includes a screw driver bit forward end of a forward first configuration and a screw driver bit rear end including a first cavity defined by a first screw driver cavity configuration, and at least a further one of the plurality of adapter screw driver bits includes a further screw driver bit forward end of a forward second configuration and a second cavity directed within a further screw driver bit rear end of the further one of the screw adapter screw driver bits defined by a second screw driver cavity configuration.

* * * * *